US009861260B2

(12) United States Patent
Benedict et al.

(10) Patent No.: US 9,861,260 B2
(45) Date of Patent: Jan. 9, 2018

(54) DISHWASHER APPLIANCE AND A TINE ASSEMBLY FOR A DISHWASHER APPLIANCE

(71) Applicant: General Electric Company, Schenectady, NY (US)

(72) Inventors: Michael Alexander Benedict, Louisville, KY (US); Rebecca Ann Alvord, Louisville, KY (US); Ryan James Diener, Louisville, KY (US); Brian Michael Schork, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 961 days.

(21) Appl. No.: 14/224,533

(22) Filed: Mar. 25, 2014

(65) Prior Publication Data

US 2015/0272421 A1 Oct. 1, 2015

(51) Int. Cl.

| | |
|---|---|
| ***A47L 15/42*** | (2006.01) |
| ***A47L 15/48*** | (2006.01) |
| ***A47L 15/50*** | (2006.01) |

(52) U.S. Cl.

CPC ..... *A47L 15/508* (2013.01); *A47L 15/428* (2013.01); *A47L 15/4282* (2013.01); *A47L 15/48* (2013.01); *A47L 15/503* (2013.01); *A47L 15/505* (2013.01)

(58) Field of Classification Search

CPC .... A47L 15/428; A47L 15/4282; A47L 15/48; A47L 15/503; A47L 15/505; A47L 15/508

USPC .. 134/56 D, 57 D, 58 D, 172, 174, 183, 198

See application file for complete search history.

(56) References Cited

U.S. PATENT DOCUMENTS

| | | | | |
|---|---|---|---|---|
| 4,869,375 | A | 9/1989 | Lamb | |
| 2008/0308510 | A1 | 12/2008 | Richardson | |
| 2012/0291827 | A1* | 11/2012 | Buddharaju | A47L 15/4278 134/198 |

FOREIGN PATENT DOCUMENTS

| | | |
|---|---|---|
| EP | 2454984 | 5/2012 |
| EP | 2554098 | 2/2013 |

* cited by examiner

*Primary Examiner* — Levon J Shahinian

(74) *Attorney, Agent, or Firm* — Dority & Manning, P.A.

(57) ABSTRACT

A tine assembly for a dishwasher appliance is provided. The tine assembly includes a plurality of segmented tines. Each segmented tine of the plurality of segmented tines includes a plurality of tine segments. Each tine segment of the plurality of tine segments is pivotally or rotatably mounted to a respective adjacent tine segment of the plurality of tine segments such that the segmented tines of the plurality of segmented tines are compliant. A related dishwasher appliance is also provided.

14 Claims, 6 Drawing Sheets

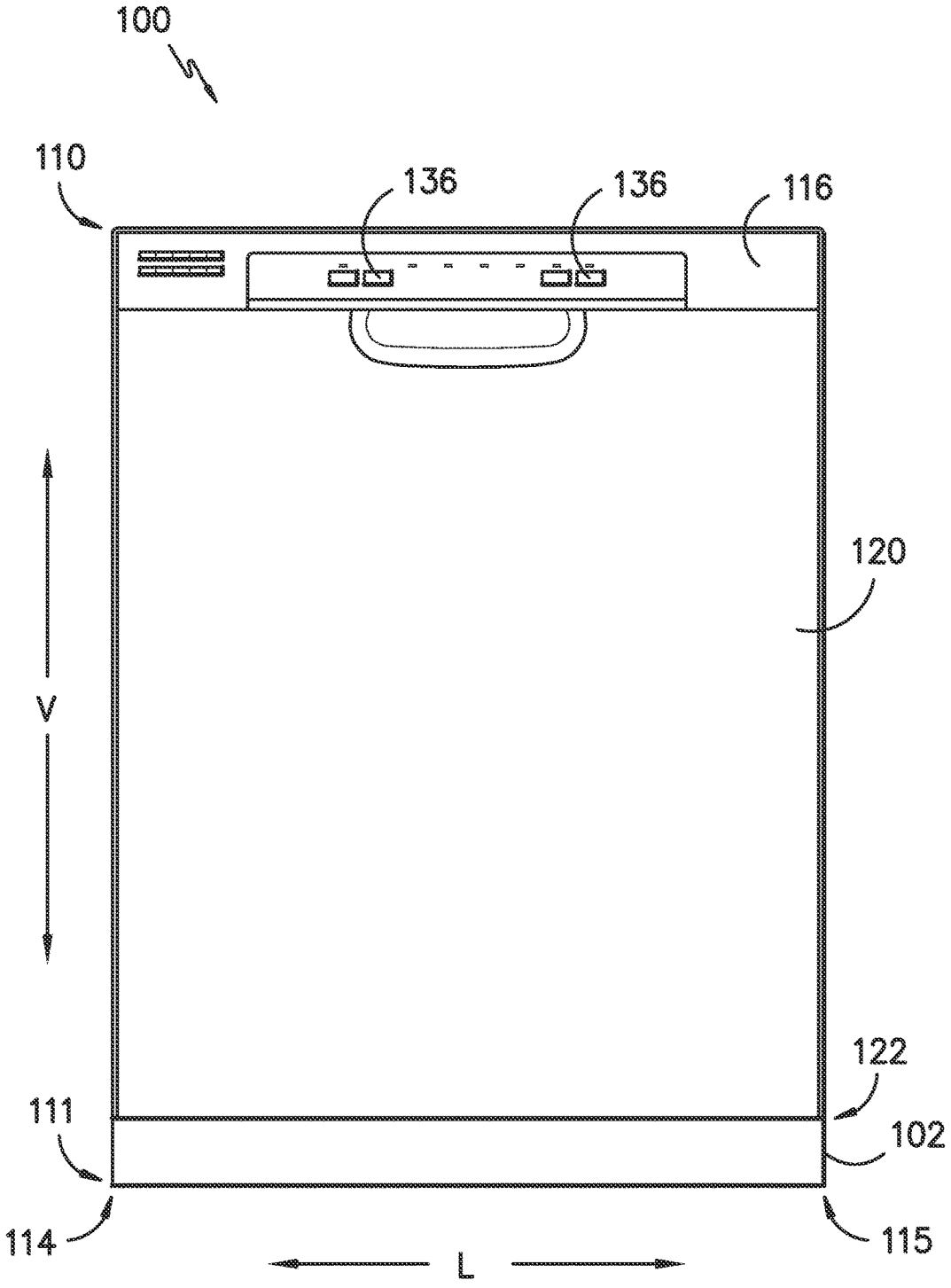
FIG. —1—

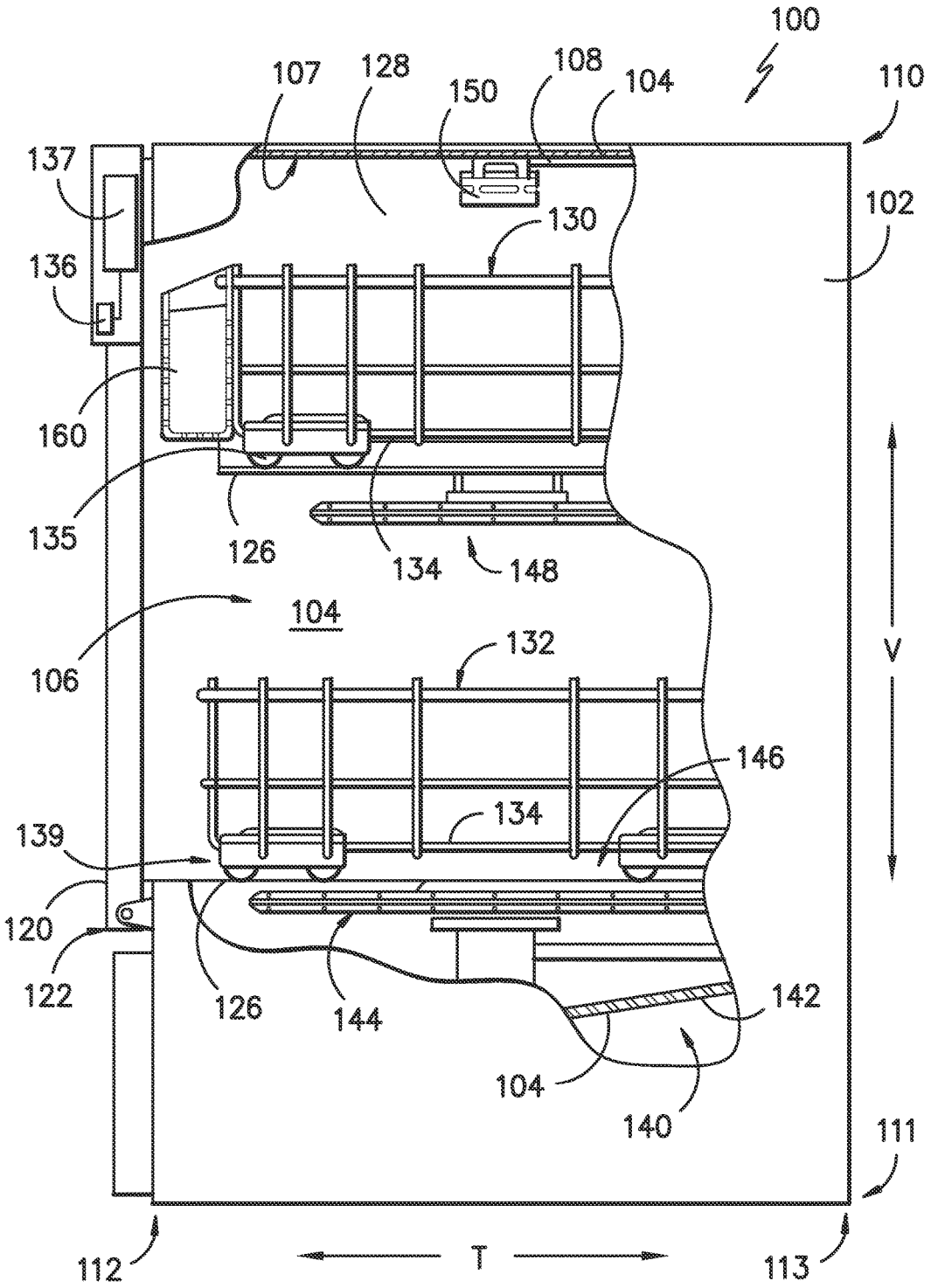
FIG. —2—

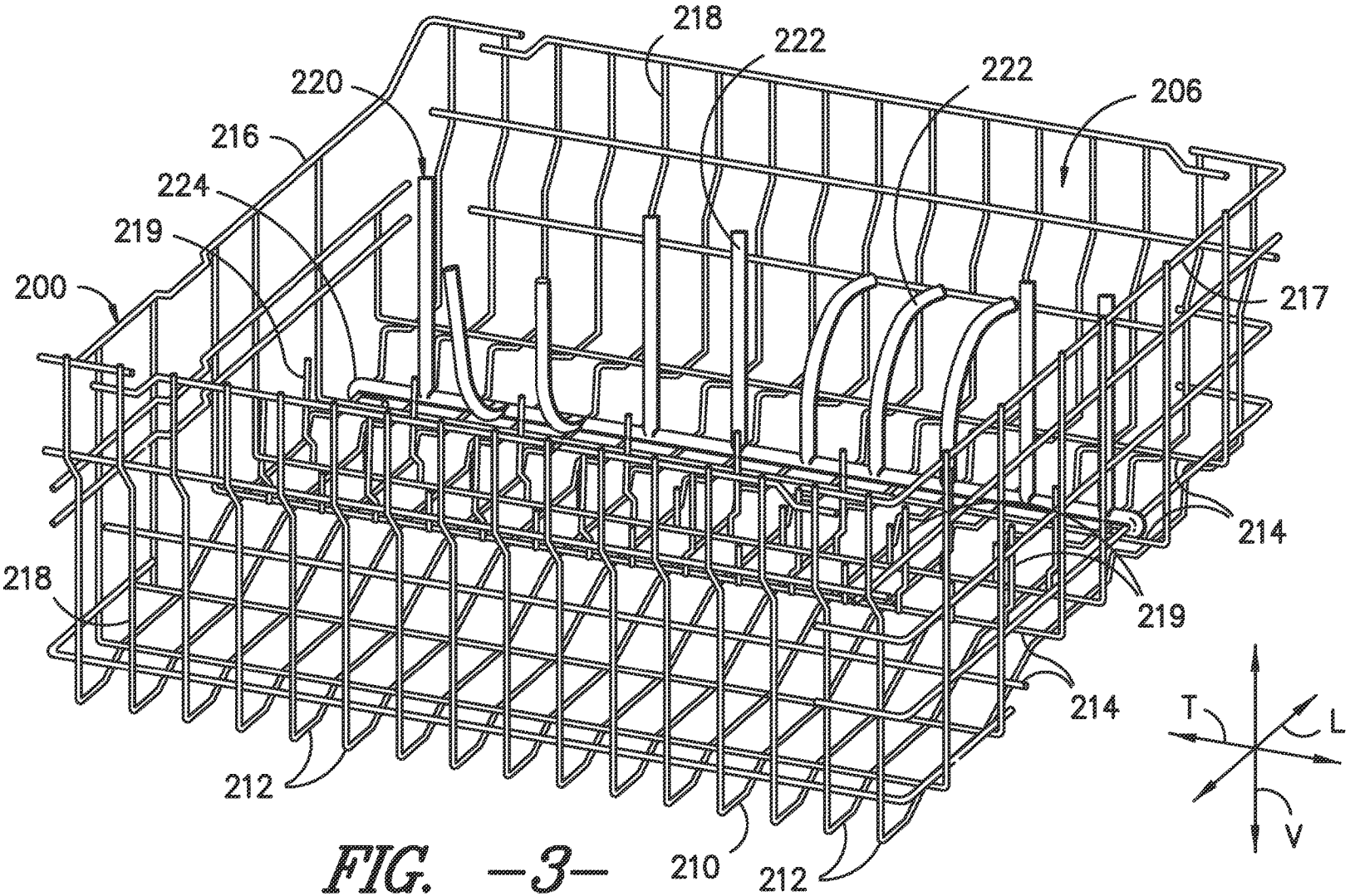
FIG. —3—

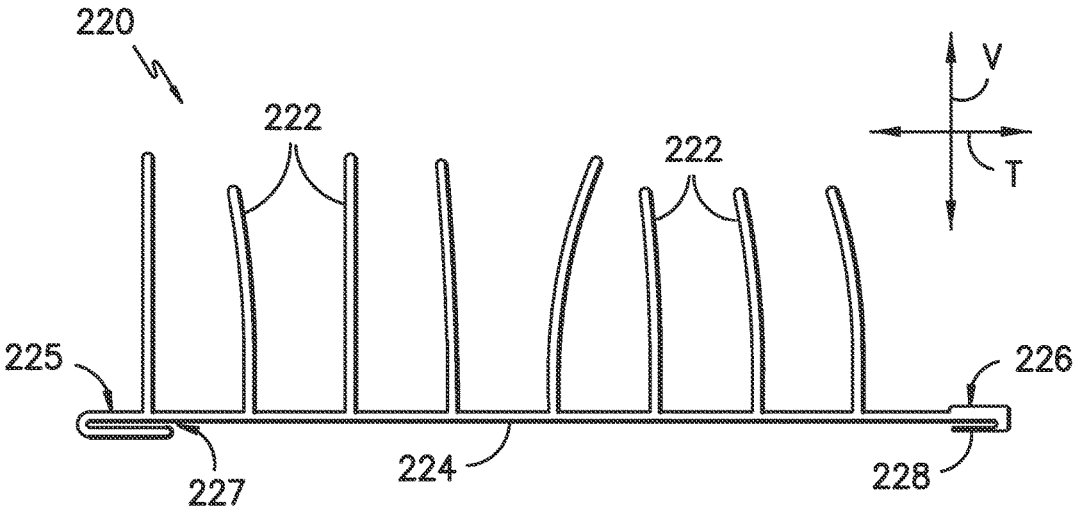
FIG. —4—
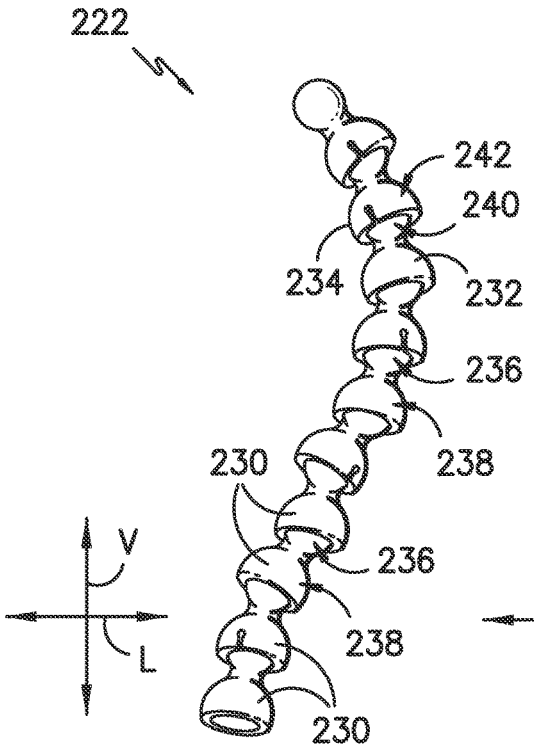
FIG. —5—
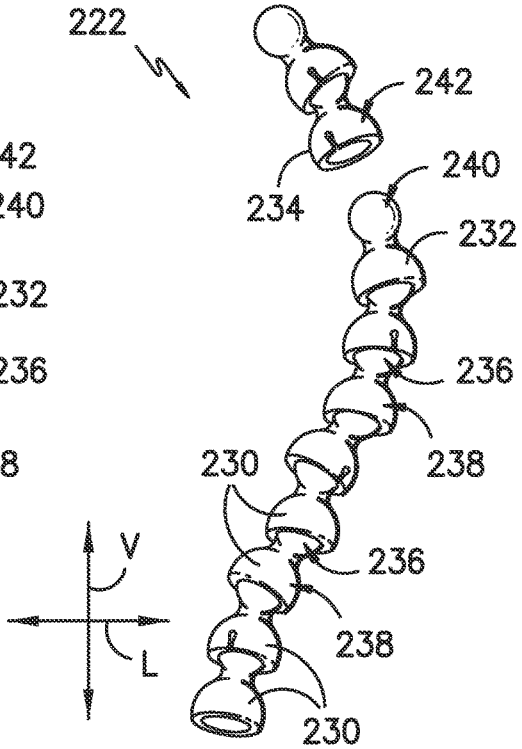
FIG. —6—

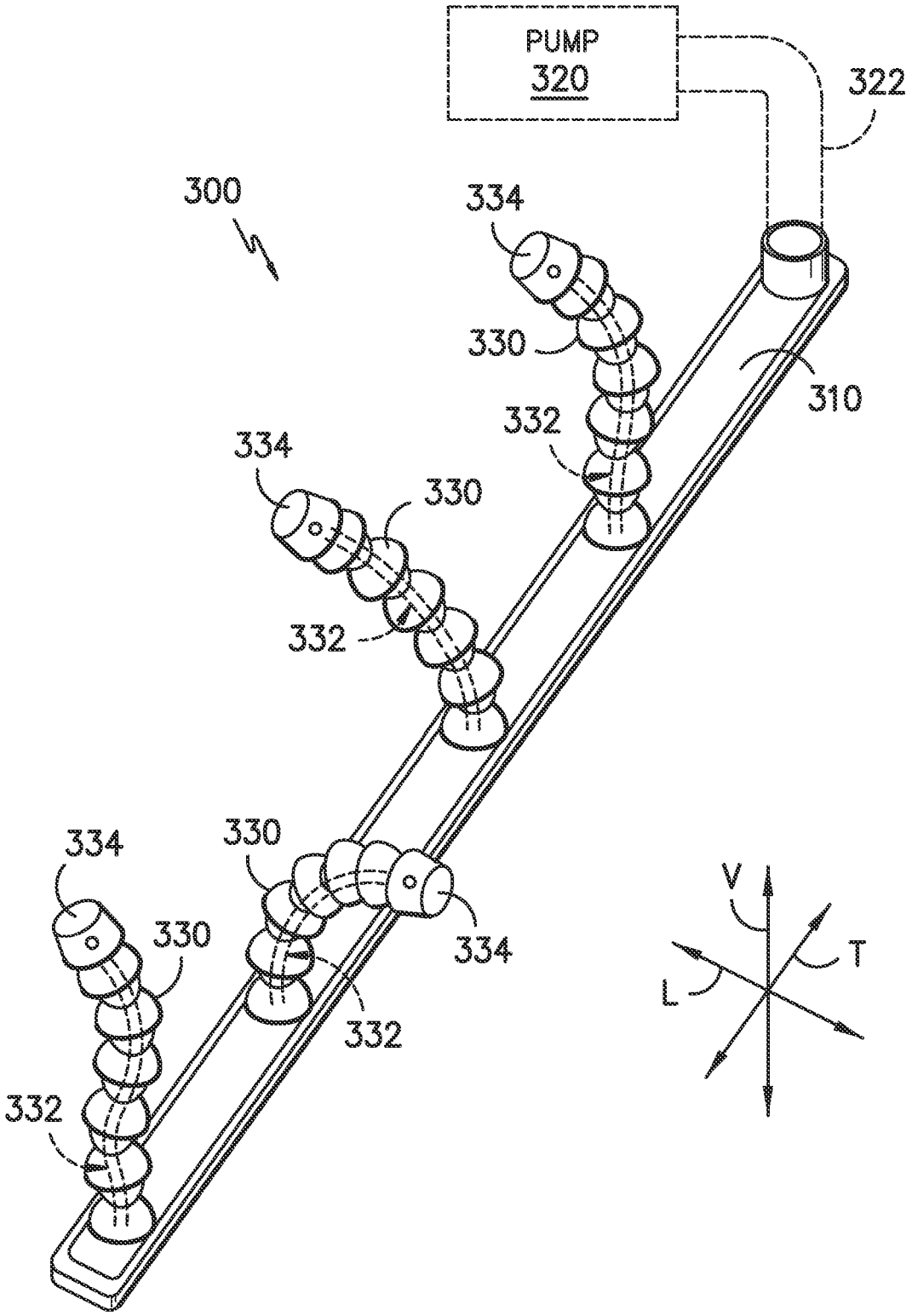
FIG. —7—

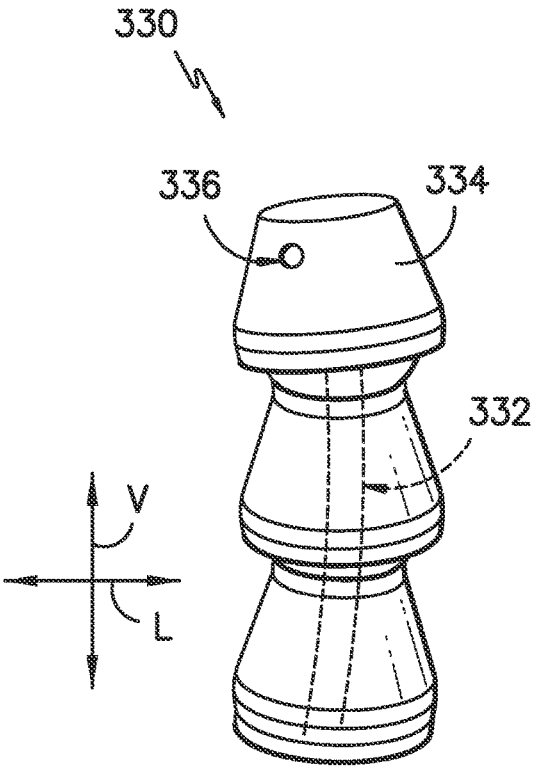
FIG. —8—
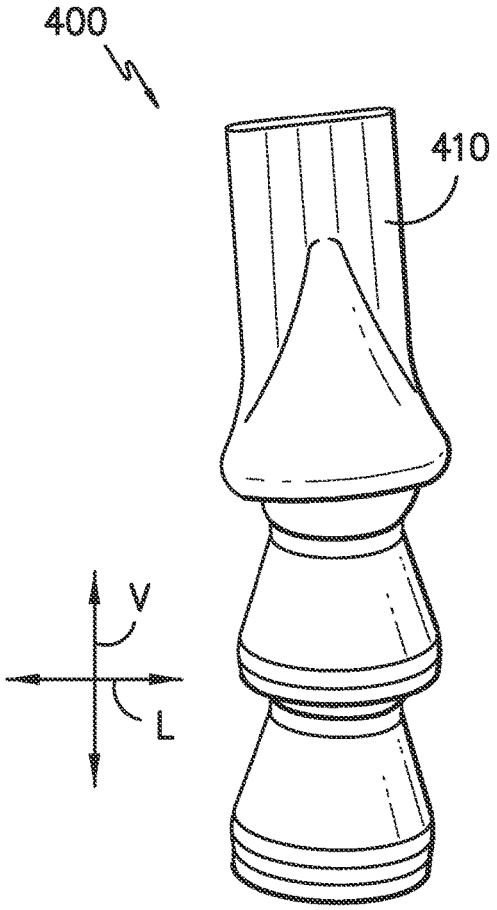
FIG. —9—

DISHWASHER APPLIANCE AND A TINE ASSEMBLY FOR A DISHWASHER APPLIANCE

FIELD OF THE INVENTION

The present subject matter relates generally to dishwasher appliances and tines for the same.

BACKGROUND OF THE INVENTION

Dishwasher appliances generally include a tub that defines a wash chamber. Wash fluid is applied to articles within the wash chamber to remove food particles and other debris during operation of the dishwasher appliance. Certain dishwasher appliances include rack assemblies for supporting the articles within the wash chamber. For example, an upper rack assembly may be disposed at a top of the washing chamber and may be used to hold glasses, cups and other small articles. As another example, a lower rack assembly may be positioned at a bottom of the wash chamber and may be used to support dishes, platters, food preparation bowls, pots and other large articles.

The upper and lower rack assemblies are commonly provided with an array of spaced apart, generally vertical tines that assist with spacing and supporting articles within the upper and lower rack assemblies. The tines are generally elongated rigid metal wires that extend vertically from a bottom wall of the upper and lower rack assemblies. Supporting certain items with such tines can be difficult. For example, sprays of wash fluid can remove small or light-weight items, such as baby bottles, plastic cups or storage containers, from such tines during operation of the dishwasher appliance. As another example, irregularly sized articles may be difficult to properly position between such tines.

Accordingly, a dishwasher appliance with features for supporting small or light-weight items within a rack assembly of the dishwasher appliance would be useful. In addition, a dishwasher appliance with features for supporting irregularly sized articles within a rack assembly of the dishwasher appliance would be useful.

Dishwasher appliances also generally include spray assemblies for directing flows of wash fluid towards articles within the rack assemblies. Certain dishwasher appliances include rotating spray arms that are positioned proximate the rack assemblies and direct sprays of wash fluid towards the rack assemblies during operation of the dishwasher appliance. However, such spray arms may not apply a continuous spray of wash fluid at any one location in the rack assembly and may instead provide an intermittent spray at a given location.

Accordingly, a dishwasher appliance with features for assisting a user with directing sprays of wash fluid towards articles within a rack assembly of the dishwasher appliance would be useful. In particular, a dishwasher appliance with features for assisting a user with directing various sprays of wash fluid towards irregularly shaped articles or articles with deep interior volumes would be useful.

BRIEF DESCRIPTION OF THE INVENTION

The present subject matter provides a tine assembly for a dishwasher appliance. The tine assembly includes a plurality of segmented tines. Each segmented tine of the plurality of segmented tines includes a plurality of tine segments. Each tine segment of the plurality of tine segments is pivotally or rotatably mounted to a respective adjacent tine segment of the plurality of tine segments such that the segmented tines of the plurality of segmented tines are compliant. A related dishwasher appliance is also provided. Additional aspects and advantages of the invention will be set forth in part in the following description, or may be apparent from the description, or may be learned through practice of the invention.

In a first exemplary embodiment, a dishwasher appliance is provided. The dishwasher appliance includes a tub that defines a wash chamber. A rack assembly is disposed within the wash chamber of the tub. A plurality of segmented tines is positioned within the rack assembly. Each segmented tine of the plurality of segmented tines includes a plurality of tine segments. Each tine segment of the plurality of tine segments is mounted to a respective adjacent tine segment of the plurality of tine segments such that each tine segment of the plurality of tine segments is pivotable relative to the respective adjacent tine segment of the plurality of tine segments.

In a second exemplary embodiment, a tine assembly for a dishwasher appliance is provided. The tine assembly defines a vertical direction, a lateral direction and a transverse direction. The vertical, lateral and transverse directions are mutually perpendicular. The tine assembly includes a mounting bracket that extends along the transverse direction between a first end portion and a second end portion. A plurality of segmented tines is mounted to the mounting bracket and extends away from the mounting bracket along the vertical direction. Each segmented tine of the plurality of segmented tines includes a plurality of tine segments. Each tine segment of the plurality of tine segments is pivotally mounted to a respective adjacent tine segment of the plurality of tine segments such that the segmented tines of the plurality of segmented tines are compliant along at least one of the lateral and transverse directions.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

FIG. 1 provides a front, elevation view of a dishwasher appliance according to an exemplary embodiment of the present subject matter.

FIG. 2 provides a side, elevation view of the exemplary dishwasher appliance of FIG. 1 with portions of a cabinet of the exemplary dishwasher appliance removed in order to show certain internal components of the exemplary dishwasher appliance.

FIG. 3 provides a perspective view of a rack assembly and a tine assembly according to an exemplary embodiment of the present subject matter.

FIG. 4 provides a side, elevation view of the exemplary tine assembly of FIG. 3.

FIGS. 5 and 6 provide perspective views of a segmented tine of the exemplary tine assembly in FIG. 3.

FIG. 7 provides a perspective view of a tine assembly according to another exemplary embodiment of the present subject matter.

FIG. 8 provides a perspective view of a portion of a segmented tine of the exemplary tine assembly of FIG. 7.

FIG. 9 provides a perspective view of a segmented tine according to another exemplary embodiment of the present subject matter.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIGS. 1 and 2 depict a dishwasher appliance 100 according to an exemplary embodiment of the present subject matter. Dishwasher appliance 100 includes a cabinet 102 having a tub 104 therein that defines a wash compartment 106. In particular, tub 104 includes a top wall 107 that assists in defining wash compartment 106. Tub 104 also includes a door 120 hinged at its bottom 122 for movement between a normally closed configuration (shown in FIGS. 1 and 2) in which wash compartment 106 is sealed shut, e.g., for washing operation, and an open configuration, e.g., for loading and unloading of articles from dishwasher appliance 100.

Dishwasher appliance 100 defines a vertical direction V, a lateral direction L and a transverse direction T. The vertical direction V, the lateral direction L and the transverse direction T are mutually perpendicular and form an orthogonal direction system. As may be seen in FIG. 1, dishwasher appliance 100 extends between a top portion 110 and a bottom portion 111 along the vertical direction V and also extends between a first side portion 114 and a second side portion 115 along the lateral direction L. As may be seen in FIG. 2, dishwasher appliance 100 also extends between a front portion 112 and a back portion 113 along the transverse direction T.

Guide rails 126 are mounted on tub side walls 128 and accommodate upper and lower roller-equipped rack assemblies 130 and 132. Each of the upper and lower rack assemblies 130 and 132 is fabricated from lattice structures that include a plurality of elongated members 134. Each rack of the upper and lower rack assemblies 130 and 132 is adapted for movement between an extended loading position (not shown) in which the rack is substantially positioned outside the wash compartment 106, and a retracted position (shown in FIGS. 1 and 2) in which the rack is located inside the wash compartment 106.

A silverware basket 160 is removably mounted to upper rack assembly 130. However, silverware basket 160 may also be selectively attached to other portions of dishwasher appliance 100, e.g., lower rack 132 or door 120. Silverware rack 160 is configured for receipt of silverware, utensils, and the like, that are too small to be accommodated by the upper and lower rack assemblies 130 and 132.

The dishwasher appliance 100 further includes a lower spray assembly 144 that is mounted within a lower region 146 of the wash compartment 106 and above a tub sump portion 142 so as to be in relatively close proximity to the lower rack 132. A mid-level spray assembly 148 is located in an upper region of the wash compartment 106 and may be located in close proximity to upper rack 130. Additionally, an upper spray assembly 150 is located above the upper rack 130 and mounted to top wall 107 of tub 104.

The lower and mid-level spray assemblies 144 and 148 and the upper spray assembly 150 are fed by a fluid circulation pump or assembly (not shown) for circulating water and wash fluid (e.g., detergent, water, and/or rinse aid) in the tub 104. The fluid circulation assembly may be located in a machinery compartment 140 located below the bottom sump portion 142 of the tub 104, as generally recognized in the art. The fluid circulation assembly also includes circulation piping 108 that directs liquid water and/or wash fluid to upper spray assembly 150.

Each spray assembly includes an arrangement of discharge ports or orifices for directing washing liquid onto dishes or other articles located in the upper and lower racks 130, 132 and silverware basket 160. The lower and mid-level spray assemblies 144 and 148 may be rotatably mounted in wash compartment 106. Accordingly, the arrangement of the discharge ports in at least the lower spray assembly 144 may provide a rotational force by virtue of washing fluid flowing through the discharge ports. The resultant rotation of the lower spray assembly 144 can provide coverage of dishes and other dishwasher contents with a washing spray.

The dishwasher appliance 100 is further equipped with a controller 137 to regulate operation of the dishwasher appliance 100. The controller may include a memory and microprocessor, such as a general or special purpose microprocessor operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor.

The controller 137 may be positioned in a variety of locations throughout dishwasher appliance 100. In the illustrated embodiment, the controller 137 may be located within a control panel 116 of door 120 as shown. In such an embodiment, input/output ("I/O") signals may be routed between the control system and various operational components of dishwasher appliance 100 along wiring harnesses that may be routed through the bottom 122 of door 120. Typically, the controller 137 includes a user interface panel 136 through which a user may select various operational features and modes and monitor progress of the dishwasher appliance 100. In one embodiment, the user interface 136 may represent a general purpose I/O ("GPIO") device or functional block. In one embodiment, the user interface 136 may include input components, such as one or more of a variety of electrical, mechanical or electro-mechanical input devices including rotary dials, push buttons, and touch pads. The user interface 136 may include a display component, such as a digital or analog display device designed to provide operational feedback to a user. The user interface 136 may be in communication with the controller 137 via one or more signal lines or shared communication busses.

It should be appreciated that the present subject matter is not limited to any particular style, model, or other configuration of dishwasher appliance and that dishwasher appliance 100 depicted in FIGS. 1 and 2 is provided for illustrative purposes only. For example, the present subject matter may be used in dishwasher appliances having other rack configurations.

FIG. 3 provides a perspective view of a rack assembly 200 and a tine assembly 220 according to an exemplary embodiment of the present subject matter. FIG. 4 provides a side, elevation view of tine assembly 220. Rack assembly 200 may be used in any suitable dishwasher appliance. As an example, rack assembly 200 may be utilized in dishwasher appliance 100, e.g., as upper rack assembly 130 (FIG. 2). Similarly, tine assembly 220 may be used in any suitable dishwasher appliance. As an example, tine assembly 220 may be utilized in dishwasher appliance 100, e.g., within upper rack assembly 130. Tine assembly 220 includes features for supporting and/or holding articles within rack assembly 200, as discussed in greater detail below.

As may be seen in FIG. 3, rack assembly 200 defines an interior volume 206. In particular, a bottom wall 210, a back wall 216, a front wall 217 and side walls 218 of rack assembly 200 may assist with defining interior volume 206 of rack assembly 200. Thus, interior volume 206 of rack assembly 200 may be defined between bottom wall 210, back wall 216, front wall 217 and side walls 218 of rack assembly 200. Articles for washing, such as cups, bowls, bottles, etc., may be placed or positioned within interior volume 206 of rack assembly 200 such that the articles for washing are supported by rack assembly 200 during operation of dishwasher appliance 100.

Rack assembly 200 also includes a plurality of fixed tines 219 for assisting with supporting articles within interior volume 206 of rack assembly 200. Fixed tines 219 are mounted to bottom wall 210 of rack assembly 200 and extend into interior volume 206 of rack assembly 200, e.g., upwardly along the vertical direction V. In particular, as shown in FIG. 3, bottom wall 210 may include a series of lateral members 212 fixed to a series of transverse members 214. Each lateral member of lateral members 212 extends along the lateral direction L. Lateral members 212 are also spaced apart from one another along the transverse direction T. Similarly, each transverse member of transverse members 214 extend along the transverse direction T. Transverse members 214 are also spaced apart from one another along the lateral direction L. Thus, lateral members 212 and transverse members 214 form a lattice structure for containing articles within rack assembly 200. Fixed tines 219 may be mounted or fixed (e.g., welded) to lateral members 212 and/or transverse members 214 of bottom wall 210 of rack assembly 200 and extend into interior volume 206 of rack assembly 200, e.g., upwardly along the vertical direction V, from bottom wall 210.

Tine assembly 220 also assists with supporting articles within interior volume 206 of rack assembly 200. As may be seen in FIGS. 3 and 4, tine assembly 220 includes a plurality of segmented tines 222 (shown schematically in FIGS. 3 and 4). Segmented tines 222 are positioned within interior volume 206 of rack assembly 200. In particular, fixed tines 219 and segmented tines 222 are spaced apart from one another, e.g., along the transverse direction T, within interior volume 206 of rack assembly 200. As another example, segmented tines 222 may be distributed between fixed tines 219 within interior volume 206. Thus, each segmented tine of segmented tines 222 may be positioned between a respective pair of fixed tines 219, e.g., along the transverse direction.

Articles within interior volume 206 of rack assembly 200 may be positioned on or over segmented tines 222 such that the articles are supported by segmented tines 222 and movement of the articles is limited by segmented tines 222. In addition, segmented tines 222 are flexible or compliant, as discussed in greater detail below. This, segmented tines 222 may be bent or adjusted to contact articles within interior volume 206 of rack assembly 200 and hold the articles within rack assembly 200.

Turning now to FIG. 4, tine assembly 220 includes a mounting bracket 224. Segmented tines 222 are mounted or secured to mounting member or bracket 224. Segmented tines 222 also extend away from mounting bracket 224, e.g., along the vertical direction V into interior volume 206 of rack assembly 200. Mounting bracket 224 also extends between a first end portion 225 and a second end portion 226, e.g., along the transverse direction T. Segmented tines 222 are distributed, e.g., along the transverse direction T, between first and second end portions 225 and 226 of mounting bracket 224.

Mounting bracket 224 may be mounted or secured to rack assembly 200, e.g., bottom wall 210 of rack assembly 200. As may be seen in FIG. 4, mounting bracket 224 defines a slot 227, e.g., at first end portion 225 of mounting bracket 224. Slot 227 is sized for receiving one of lateral members 212 and/or transverse members 214 of bottom wall 210. Mounting bracket 224 also has a snap or hook 228, e.g., at second end portion 226 of mounting bracket 224. Hook 228 is configured for selectively engaging lateral members 212 and/or transverse members 214 of bottom wall 210. Thus, one of lateral members 212 may be disposed within slot 227, and hook 228 may be snapped or hooked onto another one of lateral members 212 in order to, e.g., removably, mount tine assembly 220 to bottom wall 210 of rack assembly 200 as shown in FIG. 3.

FIGS. 5 and 6 provide perspective views of a segmented tine 222 of tine assembly 220. As may be seen in FIGS. 5 and 6, segmented tine 222 includes a plurality of tine segments 230. Each tine segment of tine segments 230 is mounted to a respective adjacent tine segment of tine segments 230. For example, tine segments 230 include a first tine segment 232 and a second tine segment 234. First and second tine segments 232 and 234 are mounted to each other or coupled together. Segmented tine 222 may include any suitable number of tine segments 230. For example, segmented tine 222 may include ten tine segments as shown in FIGS. 5 and 6. In alternative exemplary embodiments, segmented tine 222 may include at least five tine segments, at least seven tine segments, at least fifteen tine segments or at least twenty tine segments.

As discussed above, segmented tines 222 are flexible or compliant. In particular, tine segments 230 may permit segmented tines 222 to be flexible or compliant, e.g., along at least one of the lateral direction L and the transverse direction T. To provide such flexibility or compliance, each tine segment of tine segments 230 may be mounted to the respective adjacent tine segment of tine segments 230 such that each tine segment of tine segments 230 is pivotable or rotatable relative to the respective adjacent tine segment of tine segments 230. As an example, first tine segment 232 may be mounted to second tine segment 234 such that first tine segment 232 is pivotable or rotatable relative to second tine segment 234. Thus, segmented tines 222 may be bent or adjusted to contact articles within interior volume 206 of rack assembly 200 and hold the articles within rack assembly 200, e.g., by rotating or pivoting tine segments 230 relative to one another.

In the exemplary embodiment shown in FIGS. 5 and 6, each tine segment of tine segments 230 includes a spherical portion 236 and a cup portion 238. Spherical portion 236 and cup portion 238 of tine segments 230 may be integral or continuous with each other. Thus, as an example, each tine segment of tine segments 230 may be formed of a single continuous piece of material, such as a molded polymer.

As shown in FIG. 5, the spherical portion 236 of each tine segment of tine segments 230 is received within the cup portion 238 of the respective adjacent tine segment of tine segments 230. As an example, a spherical portion 240 of first tine segment 232 may be received within a cup portion 242 of second tine segment 234. In such manner, first and second tine segments 232 and 234 may be mounted to each other and coupled together. Spherical portion 240 of first tine segment 232 may rotate and/or pivot within cup portion 242 of second tine segment 234 when spherical portion 240 of first tine segment 232 is received within a cup portion 242 of second tine segment 234.

An interference fit between each tine segment of tine segments 230 and the respective adjacent tine segment of tine segments 230 may mount each tine segment of tine segments 230 to the respective adjacent tine segment of tine segments 230. As an example, an interference fit between spherical portion 240 of first tine segment 232 and cup portion 242 of second tine segment 234 may couple first and second tine segments 232 and 234 together. To provide such interference fit, cup portion 242 of second tine segment 234 may elastically deform during insertion of spherical portion 240 of first tine segment 232 into cup portion 242 of second tine segment 234.

As may be seen in FIGS. 5 and 6, each tine segment of tine segments 230 may be removably mounted to the respective adjacent tine segment of tine segments 230. As an example, cup portion 242 of second tine segment 234 may elastically deform during insertion of spherical portion 240 of first tine segment 232 into cup portion 242 of second tine segment 234 and during removal of spherical portion 240 of first tine segment 232 from cup portion 242 of second tine segment 234. In such a manner, tine segments 230 may be removably mounted to one another. Thus, a length of segmented tine 222 may be selectively adjusted, e.g., by adding or removing any suitable number of tine segments 230 from segmented tine 222.

FIG. 7 provides a perspective view of a tine assembly 300 according to another exemplary embodiment of the present subject matter. Tine assembly 300 may be used in any suitable dishwasher appliance. As an example, tine assembly 300 may be utilized in dishwasher appliance 100, e.g., within upper rack assembly 130. Tine assembly 300 includes features for directing sprays of wash fluid towards articles within an associated rack assembly.

As may be seen in FIG. 7, tine assembly 300 includes a supply conduit 310 and a plurality of segmented tines 330. Segmented tines 330 are flexible or complaint. Thus, segmented tines 330 may be constructed in a similar manner to segmented tines 222 (FIG. 5), e.g., such that segmented tines 330 are flexible or complaint. Tine assembly 300 may include any suitable number of segmented tines 330. As shown in the exemplary embodiment of FIG. 7, tine assembly 300 may include four segmented tines. In alternative exemplary embodiments, tine assembly 300 may include at least three segmented tines, at least six segmented tines, at least ten segmented tines, etc.

Segmented tines 330 are mounted to and extend from supply conduit 310, e.g., upwardly along the vertical direction V. Each segmented tine of segmented tines 330 may define a channel 332 therein. Channels 332 of segmented tines 330 are in fluid communication with supply conduit 310 such that fluid within supply conduit 310 may flow into the channels 332 of segmented tines 330. A pump 320, such as a recirculation pump of dishwasher appliance 100, is fluidly coupled to supply conduit 310, e.g., via suitable piping or hoses 322 that extend between pump 320 and supply conduit 310. Pump 320 is operable to supply or urge a fluid to supply conduit 310. From supply conduit 310, such fluid flows though channels 332 of segmented tines 330 to an exit, e.g., at a distal end of segmented tines 330, as discussed in greater detail below.

FIG. 8 provides a perspective view of a portion of segmented tine 330 of tine assembly 300. As may be seen in FIG. 8, segmented tine 330 includes a, e.g., rotating, spray nozzle 334 at the distal end of segmented tine 330. Spray nozzle 334 is configured for receiving liquid wash fluid from supply conduit 310 during operation of pump 320 and directing such wash fluid towards articles within an associated rack assembly, such as rack assembly 200.

As discussed above, segmented tine 330 is flexible or compliant. Thus, a position of spray nozzle 334 within an associated rack assembly may be adjusted or changed by bending or pivoting segmented tine 330, and a user of an associated dishwasher appliance may position spray nozzle 334 at a desired location by bending or moving segmented tine 330. In such a manner, performance of the associated dishwasher appliance may be improved by directing wash fluid towards a desired location, e.g., where wash fluid is most needed or difficult to reach with other spray assemblies of the associated dishwasher appliance.

Spray nozzle 334 includes an outlet 336. As discussed above, spray nozzle 334 may rotate during operation of the associated dishwasher appliance. Thus, a spray of wash fluid directed out of outlet 336 of spray nozzle 334 may rotate during operation of the associated dishwasher appliance. In such a manner, a distribution of wash fluid from spray nozzle 334 may be improved, e.g., made more uniform.

FIG. 9 provides a perspective view of a segmented tine 400 according to another exemplary embodiment of the present subject matter. Segmented tine 400 may be used on tine assembly 300 (FIG. 7), e.g., as segmented tines 330. As may be seen in FIG. 9, segmented tine 400 includes an air nozzle 410 at the distal end of segmented tine 400. Thus, air nozzle 400 may be configured for receiving air (or another suitable gas) from supply conduit 310 during operation of pump 320 and directing the air towards articles within an associated rack assembly, such as rack assembly 200.

As discussed above with respect to segmented tine 300, segmented tine 400 is flexible or compliant. Thus, a position of air nozzle 410 within an associated rack assembly may be adjusted or changed by bending or pivoting segmented tine 400, and a user of a dishwasher appliance may position air nozzle 410 at a desired location by bending or moving segmented tine 400. As an example, the user of the dishwasher appliance may position air nozzle 410 at a top of a coffee cup such that during a drying cycle of the dishwasher appliance, a flow of air from the air nozzle 410 is directed towards the top of the coffee cup and any liquid that has collected on the top of the coffee cup is blown off or dried with the flow of air.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A dishwasher appliance, comprising:

a tub defining a wash chamber;

a rack assembly disposed within the wash chamber of the tub; and a plurality of segmented tines positioned within the rack assembly, each segmented tine of the plurality of segmented tines comprising a plurality of tine segments, each tine segment of the plurality of tine segments mounted to a respective adjacent tine segment of the plurality of tine segments such that each tine segment of the plurality of tine segments is pivotable relative to the respective adjacent tine segment of the plurality of tine segments, wherein the plurality of tine segments of each segmented tine of the plurality of segmented tines comprises no fewer than five tine segments, wherein each tine segment of the plurality of tine segments comprises a spherical portion and a cup portion, the spherical portion of each tine segment of the plurality of tine segments receivable within the cup portion of the respective adjacent tine segment of the plurality of tine segments such that each tine segment of the plurality of tine segments is removably mounted to the respective adjacent tine segment of the plurality of tine segments with an interference fit between the each tine segment of the plurality of tine segments and the respective adjacent tine segment of the plurality of tine segments.

2. The dishwasher appliance of claim 1, wherein each tine segment of the plurality of tine segments is rotatable relative to the respective adjacent tine segment of the plurality of tine segments.

3. The dishwasher appliance of claim 1, further comprising a pump and a supply conduit, the pump fluidly coupled to the supply conduit, the plurality of segmented tines extending from the supply conduit, each segmented tine of the plurality of segmented tines defining a channel therein.

4. The dishwasher appliance of claim 3, wherein the pump is operable to supply a flow of liquid wash fluid to the supply conduit.

5. The dishwasher appliance of claim 4, wherein at least one segmented tine of the plurality of segmented tines includes a rotating spray nozzle disposed at a distal end of the at least one segmented tine.

6. The dishwasher appliance of claim 3, wherein the pump is operable to supply a flow of air to the supply conduit.

7. The dishwasher appliance of claim 6, wherein at least one segmented tine of the plurality of segmented tines includes an air nozzle disposed at a distal end of the at least one segmented tine.

8. The dishwasher appliance of claim 1, further comprising a mounting bracket, the mounting bracket positioned on and mounted to a bottom wall of the rack assembly, the plurality of segmented tines mounted to the mounting bracket.

9. The dishwasher appliance of claim 8, wherein the rack assembly includes a plurality of fixed tines that extend from the bottom wall of the rack assembly, the plurality of segmented tines distributed between the fixed tines of the plurality of fixed tines.

10. The dishwasher appliance of claim 1, wherein the spherical portion and the cup portion of each tine segment of the plurality of tine segments are integral with each other.

11. A tine assembly for a dishwasher appliance, the tine assembly defining a vertical direction, a lateral direction and a transverse direction, the vertical direction, the lateral direction and the transverse direction being mutually perpendicular, the tine assembly comprising:

a mounting bracket that extends along the transverse direction between a first end portion and a second end portion;

a plurality of segmented tines mounted to the mounting bracket and extending away from the mounting bracket along the vertical direction, each segmented tine of the plurality of segmented tines comprising a plurality of tine segments, each tine segment of the plurality of tine segments pivotally mounted to a respective adjacent tine segment of the plurality of tine segments such that the segmented tines of the plurality of segmented tines are compliant along at least one of the lateral direction and the transverse direction, wherein the plurality of tine segments of each segmented tine of the plurality of segmented tines comprises no fewer than five tine segments, wherein each tine segment of the plurality of tine segments comprises a spherical portion and a cup portion, the spherical portion of each tine segment of the plurality of tine segments receivable within the cup portion of the respective adjacent tine segment of the plurality of tine segments such that each tine segment of the plurality of tine segments is removably mounted to the respective adjacent tine segment of the plurality of tine segments with an interference fit between the each tine segment of the plurality of tine segments and the respective adjacent tine segment of the plurality of tine segments.

12. The tine assembly of claim 11, wherein the segmented tines of the plurality of segmented tines are distributed along the transverse direction between the first end portion and the second end portion of the mounting bracket.

13. The tine assembly of claim 11, wherein the mounting bracket defines a slot at the first end portion of the mounting bracket, the slot sized for receiving a lattice member of a rack assembly, the mounting bracket having a hook at the second end portion of the mounting bracket, the hook configured for engaging another lattice member of the rack assembly in order to mount the tine assembly to the rack assembly.

14. The tine assembly of claim 11, wherein each segmented tine of the plurality of segmented tines defining a channel therein.

* * * * *